United States Patent [19]

Marshall et al.

[11] 3,936,538

[45] Feb. 3, 1976

[54] POLYMERIC FILM DRYER-ADDED FABRIC SOFTENING COMPOSITIONS

[75] Inventors: Susan Kathryn Marshall, Pittsburgh, Pa.; Thomas Graham Gerding, Rumson, N.J.; Elmer Miller King, Coraopolis, Pa.

[73] Assignee: Calgon Consumer Products Company Inc., Pittsburgh, Pa.

[22] Filed: Sept. 25, 1974

[21] Appl. No.: 508,931

Related U.S. Application Data

[63] Continuation-in-part of Ser. No. 452,224, March 18, 1974, abandoned.

[52] U.S. Cl. ..... 427/242; 252/8.8; 428/279

[51] Int. Cl.[2] ..... B05D 3/12; D06M 15/00; D06M 15/08

[58] Field of Search ..... 252/8.8, 8.6; 117/139.5 A, 117/109; 427/242; 428/279

[56] References Cited

UNITED STATES PATENTS

| | | | |
|---|---|---|---|
| 3,634,947 | 1/1972 | Furgal | 117/109 |
| 3,736,668 | 6/1973 | Dillarstone | 427/242 |
| 3,743,534 | 7/1973 | Zamora | 427/242 |
| 3,749,691 | 7/1973 | Kandathil | 252/8.8 |

FOREIGN PATENTS OR APPLICATIONS

| | | | |
|---|---|---|---|
| 1,313,697 | 4/1973 | United Kingdom | 117/109 |

*Primary Examiner*—Harold D. Anderson
*Assistant Examiner*—Edward Woodberry
*Attorney, Agent, or Firm*—Rudolph J. Anderson, Jr.; Harry E. Westlake; Martin L. Katz

[57] ABSTRACT

Fabric-softening compositions useful for softening and preventing static electricity in textile fabrics comprising a film-forming polymer, a softening agent and a waxy surfactant.

16 Claims, No Drawings

POLYMERIC FILM DRYER-ADDED FABRIC SOFTENING COMPOSITIONS

This application is a continuation-in-part of U.S. Ser. No. 452,224, now abandoned filed Mar. 18, 1974.

BACKGROUND OF THE INVENTION

This invention relates to a fabric-softening composition. More particularly, this invention relates to a polymeric film that softens and prevents static electricity.

Certain chemical compounds have long been known in the art to possess the desired quality of imparting softness to textile fabrics. The quality of "softness" or being "soft" is well defined in the art, and, as used herein, means that quality of the treated fabric whereby its handle or texture is smooth, pliable, and fluffy, and not rough or scratchy to the touch. Known generally as "fabric softeners", these compounds have long been used by housewives in the laundry and by the textile industry to soften a finished fabric.

Additionally, many of these compounds act to reduce the "static cling" of the treated fabrics. Static cling is generally the phenomenon of a fabric adhering to another object or to parts of itself as a result of static electrical charges located on the surface of the fabric. It can also involve the adherence of lint, dust, and other undesired substances to the fabric due to these static charges. It is noticeably present in unsoftened fabrics that are freshly washed and dried in an automatic dryer. By softening and reducing the static cling of a fabric, it is more comfortable when worn. Such treated fabrics additionally are easier to iron, and have fewer hard-to-iron wrinkles.

Generally, fabric softeners are used in the rinse cycle of an automatic clothes washer and liquid, powder, tablet, and granular formulations are known for such use.

DESCRIPTION OF THE PRIOR ART

Recently, however, fabric-softening compositions have been disclosed for use in softening fabrics in an automatic, rotary drum, clothes dryer. For example, U.S. Pat. No. 3,630,949 discloses an aerosol formulation that is sprayed directly on the surface of fabrics to dissipate static electricity and U.S. Pat. No. 3,650,816 discloses an aerosol formulation that is sprayed on the dryer drum surface whereupon the static dissipating and fabric-softening additives are transferred to clothing in the course of a normal drying cycle. U.S. Pat. No. 3,442,692 discloses a flexible substrate, as for example, a cellulosic sheet, coated with softening additives. This sheet is then tumbled with the fabrics to be softened in a dryer. U.S. Pat. No. 3,632,396 discloses a flexible substrate coated with a softener additive and an outer, waxy coating that is tumbled with fabrics in the dryer, and U.S. Pat. No. 3,686,025 discloses an absorbent substrate, as for example, a flexible sheet, ball, puff or swatch of fibrous, absorbent material that carries a softening-antistatic agent. U.S. Pat. No. 3,633,538 discloses a resilient sphere having a hollow core and openings in its surface. The sphere contains the softening agent and is tumbled with the fabrics being treated in a dryer. U.S. Pat. No. 3,634,947 discloses the use of a thin, flexible substrate that is coated with a softening agent and adhesively adhered to the dryer drum. U.S. Pat. No. 3,696,034 discloses the use of alkanolamide fabric softeners which may be coated onto substrates or formed by themselves into a cake form. U.S. Pat. No. 3,676,199 discloses a dryer-added softener comprising a rigid, form-retaining base coated with a softener. U.S. Pat. No. 3,698,095 discloses a dryer-added softener comprising a form-retaining base covered with a flexible material having an outer coating of a fabric softener.

These prior art techniques have not provided a softener composition which releases significant amounts of softener during use while leaving an easily disposable residue and minimizing adverse effects on the dryer and are, therefore, not as efficient and acceptable as possible.

Accordingly, it is an object of this invention to provide novel fabric-softening compositions that can be used to soften fabrics during the final rinse cycle of an automatic clothes washer or in an automatic rotary drum dryer.

It is a further object of this invention to provide a fabric-softening composition which imparts antistatic properties to the fabrics being treated.

It is a still further object of this invention to provide a fabric-softening composition which leaves no residue after use in the washer and an easily disposable residue in the dryer.

SUMMARY OF THE INVENTION

These and other objects are accomplished by the invention herein which is a water-soluble, heat sensitive film comprising at lease one film-forming polymer, at least one softening agent and at lease one waxy polymeric substance. Efficient fabric softener release is obtained by the dissolution of the film in the washer and by transfer of the film and agent to clothing in the dryer during tumbling. Perfumes and dyes may be incorporated in the composition, if desirable.

The fabric-softening compositions herein, while effective when used to soften fabrics in the final rinse cycle of an automatic clothes washer, find particular application in effectively softening fabrics in automatic clothes dryers. As the fabrics in the dryer contact the compositions of this invention by means of the spinning or tumbling action of the dryer's rotary drum, the fabric conditioning substances are transferred to the fabrics rendering them soft and static free.

DETAILED DESCRIPTION OF THE INVENTION

This invention relates to a fabric-softening composition comprising: (a) at least one film-forming polymer; (b) at least one fabric softening agent; and (c) at least one waxy cationic or nonionic surfactant. Optionally, the film may also contain a small amount of a perfume. While the amounts of the above listed constituents of the fabric-softening compositions of this invention may be varied by one skilled in the art, the preferred compositions comprise: (a) 20 – 50 percent by weight of at least one film-forming polymer; (b) 30 – 75 percent by weight of at least one softening agent; (c) 1 – 35 percent by weight of at least one waxy surfactant; (d) 00–10 percent by weight perfume; and (e) 0 – 1 percent by weight dye.

Any film-forming polymer can be utilized that can be cast or otherwise processed to form an essentially uniform, self-supporting film. Suitable polymers include homopolymers of ethylene oxide or vinyl alcohol, methyl vinyl ether-maleic anhydride copolymers, carboxy vinyl polymers, acrylamide or acrylic acid polymers, polyurethanes, sodium carboxy methyl cellulose, hydroxy cellulose, hydroxypropyl cellulose, methyl cellulose, sodium alginates, and natural gums such as locust bean gum, gum arabic, gum tragacanth, Irish moss extract and other suitable cellulosic derivatives. The most preferred polymers, however, are the high molecular weight polymers of ethylene oxide, vinyl alcohol, sodium carboxymethyl cellulose, hydroxyethyl cellulose and urethanes such as toluene diisocyanate or combinations and copolymers thereof. As used herein, the term "high molecular weight polymer" means any polymer having a molecular weight of at least 100,000. The preferred polymers, however, have molecular weights of at least 500,000.

The fabric softeners, as more particularly described hereinafter, can be selected from the following broadly denoted classes of compounds which contain at least one long chain group:

1. Cationic quaternary ammonium salts and imidazolium salts;
2. Nonionic compounds, such as tertiary phosphine oxides, tertiary amine oxides, ethoxylated alcohols and alkyl phenols, and ethoxylated amines;
3. Anionic soaps, sulfates and sulfonates, for example, fatty acid soaps, ethoxylated alcohol sulfates, sodium alkyl sulfates, alkyl sulfonates, sodium alkyl benzene sulfonates, and sodium or potassium alkyl glyceryl ether sulfonates;
4. Amphoteric teritary ammonium compounds;
5. Zwitterionic quaternary ammonium compounds; and
6. Compatible mixtures thereof of one or more compounds of these classes.

Particularly preferred fabric softeners herein are the cationic quaternary ammonium salts which have the general formula:

(1)

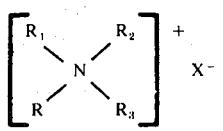

wherein "X" is an anion, preferably a halide or alkyl sulfate and more particularly, a chloride or methyl sulfate ion. Suitable other anions can include acetate, phosphate and nitrite radicals. Additionally, in the above formula, "R" and "$R_1$" represent benzyl or an alkyl radical (hereinafter referred to simply as "alkyl") containing from one to three carbon atoms, "$R_2$" represents benzyl, or an alkyl containing from one to 22 carbon atoms, or alkoxypropyl or hydroxy-substituted alkoxypropyl radicals (hereinafter referred to simply as "alkoxy") wherein the alkoxy contains from 2 to 40 carbon atoms, and "$R_3$" represents an alkyl containing from 12 to 22 carbon atoms. The carbon chains of "$R_3$" and "$R_2$", whenever "$R_2$" represents a chain of from 12 to 22 carbon atoms, can be straight or branched, and saturated or unsaturated.

Because of their known softening efficacy, the most preferred cationic fabric softeners are dialkyl dimethyl ammonium chloride or alkyl trimethyl ammonium chloride wherein the alkyl contains from 12 to 20 carbon atoms and are derived from long chain fatty acids, especially from hydrogenated tallow. The term "tallowalkoxy", used herein means an alkyl ether radical wherein the alkyl essentially contains from 16 to 18 carbon atoms.

Other cationic fabric softeners of formula (1) are known and include variables wherein "R" and "$R_1$" can also represent a phenyl radical or a hydroxy substituted alkyl of from one to three carbon atoms.

Cationic quaternary imidazolinium compounds are also preferred as fabric softeners in the compositions herein. These compounds conform to the formula:

(2)

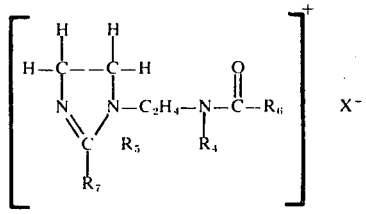

wherein "$R_5$" is an alkyl containing from one to four, preferably from one to two, carbon atoms, "$R_6$" is an alkyl containing from one to four carbon atoms or a hydrogen radical, "$R_7$" is an alkyl containing from eight to 25, preferably at least 15, carbon atoms, "$R_4$" is hydrogen or an alkyl containing from eight to 25, preferably at least 15, carbon atoms, and "X" is an anion, preferably an alkyl sulfate such as methyl sulfate or a chloride ion. Other suitable anions include those disclosed with reference to the cationic fabric softeners of formula (1). Particularly preferred are those compounds of formula (2) in which both "$R_4$" and "$R_7$" are alkyls of from 16 to 25, especially 16 to 18 and 20 to 22, carbon atoms.

Many other cationic quaternary ammonium fabric softeners, which are useful herein are known, for example, alkyl [$C_{12}$ to $C_{20}$]-pyridinium chlorides, alkyl[$C_{12}$ to $C_{20}$]-alkyl[$C_1$ to $C_3$]-morpholinium chlorides, and quaternary derivatives of amino acids and amino esters.

Other particularly preferred fabric softeners include Zwitterionic quaternary ammonium compounds which have the formula:

(3)

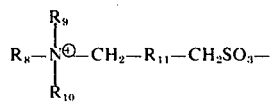

wherein "$R_9$" and "$R_{10}$" are each methyl, ethyl, n-propyl, isopropyl, 2-hydroxyethyl or 2-hydroxypropyl, "$R_8$" is a 20- to 30-carbon-atom alkyl or alkenyl radical (hereinafter referred to simply as "alkyl") and wherein said alkyl or alkenyl contains from zero to two hydroxyl substituents, from zero to five ether linkages, and from zero to one amide linkage and "$R_{11}$" is an alkylene group containing from one to four carbon atoms with from zero to one hydroxyl substituents, particularly preferred are compounds wherein "$R_8$" is a carbon chain containing from 20 to 26 carbon atoms selected from the group consisting of alkyls and alkenyls and wherein said alkyls and alkenyls contain zero to two hydroxyl substituents.

Other Zwitterionic compounds useful as fabric softeners in the compositions herein are known and include Zwitterionic synthetic detergents as represented by derivatives of aliphatic quaternary ammonium compounds wherein one of the four aliphatic groups has about eight to 20 carbon atoms (particularly 16 to 18 carbon atoms), another contains a water-solubilizing group (e. g. carboxy, sulfato or sulfo groups). Each aliphatic group can be either straight chain or branched chain, preferably straight. A more detailed disclosure of these compounds can be found in U.S. Pat. No. 3,213,030, the disclosure of which is incorporated by reference herein.

Nonionic tertiary phosphine oxide compounds are also preferred fabric softeners for use in the novel fabric softening composition herein. These compounds have the generic formula:

$$R_{12}R_{13}R_{14}P \rightarrow O \quad (4)$$

wherein "$R_{12}$" is alkyl, alkenyl, or monohydroxyalkyl having a chain length of from 20 to 30 carbon atoms and wherein "$R_{13}$" and "$R_{14}$" are each alkyl or monohydroxyalkyl containing from one to four carbon atoms, particularly preferred are tertiary phosphine oxides in which "$R_{12}$" is alkyl, alkenyl, or monohydroxyalkyl having a chain length of from 15 to 26 carbon atoms, and wherein "$R_{13}$" and "$R_{14}$" are each methyl, ethyl, or hydroxyethyl groups.

Other nonionic tertiary phosphine oxides useful herein are known and include the nonionic synthetic detergents having the same formula as that of formula (4) above wherein "$R_{12}$" is an alkyl, alkenyl, or monohydroxyalkyl of from 10 to 20 carbon atoms, and wherein "$R_{13}$" and "$R_{14}$" are each alkyl or monohydroxyalkyl of from one to three carbon atoms.

Nonionic tertiary amine oxides are also useful as fabric softeners and can be utilized in the compositions of the present invention. These nonionic compounds have the formula:

$$R_{15}R_{16}R_{17}N \rightarrow O \quad (5)$$

wherein "$R_{15}$" represents a straight or branched chain alkyl or alkenyl containing from 15 to 30 carbon atoms and from zero to two hydroxyl substituents, from zero to five ether linkages, there being at least one moiety of at least 15 carbon atoms containing no ether linkages, and zero to one amide linkage, and wherein "$R_{16}$" and "$R_{17}$" are each alkyl or monohydroxyalkyl groups containing from one to four carbon atoms and wherein "$R_{16}$" and "$R_{17}$" can be joined to form a heterocyclic group containing from four to six carbon atoms, particularly preferred are those wherein "$R_{15}$" is a straight or branched alkyl, alkenyl, or monohydroxyalkyl containing 15 to 26 carbon atoms and wherein "$R_{16}$" and "$R_{17}$" are each methyl, ethyl, or hydroxyethyl groups.

Other tertiary amine oxides useful herein are known and include compounds corresponding to formula (5) above wherein "$R_{15}$" is an alkyl of eight to 20, particularly 16 to 18, carbon atoms and "$R_{16}$" and "$R_{17}$" are methyl or ethyl radicals.

Nonionic ethoxylated alcohol compounds are also useful as fabric softeners and are preferred in the fabric-softening compositions herein. These compounds have the generic formula:

$$R_{18}\text{-}O(C_2H_4O)_xH \quad (6)$$

wherein "$R_{18}$" represents an alkyl of from 20 to 30 carbon atoms and "X" is an integer of from 3 to 45.

The particularly preferred ethoxylated alcohol compounds of this class are the condensation products of reacting from 3 moles to 45 moles of ethylene oxide with 1 mole of eicosyl alcohol,, heneicosyl alcohol, tricosyl alcohol, tetracosyl alcohol, pentacosyl alcohol, or hexacosyl alcohol. Other preferred ethoxylated alcohols are the condensation products of from 3 moles to 45 moles of ethylene oxide and 1 mole of heptacosyl, octacosyl, nonacosyl, or triacontyl alcohols.

Also suitable for use as fabric softeners in the compositions herein are nonionic synthetic detergents as represented by the polyethylene oxide condensates of aliphatic alcohols containing from eight to 20 carbon atoms and alkylphenols wherein the alkyl contains from eight to 20 carbon atoms. Particularly preferred are the condensation products of 1 mole of tallow alcohol with 20 moles and with 30 moles of ethylene oxide.

Other preferred fabric softeners for use in the compositions of this invention are ethoxylated amines of the general formula:

(7)

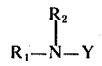

wherein "Y" is an ethoxylated group of the type $-(C_2H_4O)_xH$, wherein "X" is an integer of from 1 to 50, wherein "$R_1$" is hydrogen, "Y", or an alkyl having from one to about four carbon atoms, and wherein "$R_2$" is an alkyl having from about 12 to about 30 carbon atoms.

Also preferred as fabric softeners in the compositions herein are anionic ethoxylated alcohol sulfates and anionic sulfonates.

The preferred ethoxylated alcohol sulfates have the generic formula:

$$R_{19} - O(C_2H_4O)_xSO_3^-M^+ \quad (8)$$

wherein "X" is an integer of from 1 to 20, "M" is an alkali metal (e. g. Na, K, Li), ammonium or substituted ammonium cations, and wherein "$R_{19}$" is an alkyl containing from 15 to 30 carbon atoms.

The particularly preferred anionic ethoxylated alcohol sulfate fabric softeners are the sodium and potassium salts or the monoethanol, diethanol, or triethanol ammonium salts of the sulfated condensation product of from 1 to about 20 moles of ethylene oxide with 1 mole of eicosyl alcohol, heneicosyl alcohol, tricosyl alcohol, tetracosyl alcohol, pentacosyl alcohol, or hexacosyl alcohol.

Other preferred anionic ethoxylated sulfate compounds are the sodium or potassium salts or monoethanol, diethanol, or triethanol ammonium cations of the sulfated condensation products of from 1 to 20 moles of ethylene oxide with 1 mole of heptcosyl alcohol, octacosyl alcohol, nonacosyl alcohol, and triacontyl alcohol.

Anionic synthetic detergents as represented by alkyl sulfates of the formula:

$$R_{20} - OSO_3^-M^+ \quad (9)$$

wherein "M" is an alkali metal and "$R_{20}$" is an alkyl of from eight to 20 carbon atoms are useful as fabric softeners herein.

The preferred anionic sulfonates have the general formula:

(10)

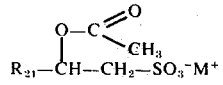

wherein "M" is an alkali metal or a substituted ammonium cation and "$R_{21}$" is an alkyl containing from 15 to 30 carbon atoms. The particularly preferred anionic sulfonates are those in which "$R_{21}$" is an alkyl containing from 15 to 26 carbon atoms.

Other fabric softeners are known in the art and can be used herein. For example, guanidines and guanidine salts are useful fabric softeners; betaines and substituted betaines are similarly useful fabric softeners.

The admixture of one or more fabric softeners of one class with one or more compatible fabric softeners of another class can be used in the compositions herein; when such admixtures are used herein, the amount of fabric softener of any one class can range from 1 percent to 99 percent, as desired, by weight of the admixture.

Other fabric-finishing additives can also be used in combinations with the fabric softeners herein. Although not essential to the invention herein, certain of these additives are particularly desirable and useful, as for example, perfumes, such as oils, spray dried powders, and encapsulated oils; brightening agents, shrinkage controllers, antistatic agents, and spotting agents. Other additives can include anticreasing agents, soil-releasing agents, fumigants, lubricants, fungicides, colorants, and sizing agents. Specific examples of possible additives disclosed herein can be found in any current Year Book of the American Association of Textile Chemists and Colorists. Any additive used should be compatible with the fabric softener.

The fabric-softening compositions of this invention also contain waxy surfactants which act as emulsifying agents in the preparation of the solution from which the film is to be cast or otherwise processed and also modify the properties of the film to give it body and enhance the release of the active agents. Suitable waxy surfactants have melting points in the range of from about 100° to about 180°F., most preferably in the range of from about 140° to about 170°F.

Particularly preferred nonionic waxy surfactants are the condensation products of 1 mole of tallow alcohol with from 10 to 40 moles of ethylene oxide (m.p. from about 100° to about 150°F.), most particularly with 20 and 30 moles of ethylene oxide (hereinafter designated, respectively, $TAE_{20}$ and $TAE_{30}$). The term "tallow", as used herein means an alkyl containing from 16 to 18 carbon atoms.

Other particularly preferred nonionic materials herein include polymers of polyethylene glycol having average molecular weights (A.M.W.) ranging from about 950 to about 7,500. Polymers of polyethylene glycol are commercially available under the trade name "Carbowax". Specific Carbowaxes which are particularly preferred herein include the following:

| Trade Name | A.M.W. | m.p. (about) |
|---|---|---|
| Carbowax 1000 | 950 – 1,050 | 97° – 103°F. |
| Carbowax 1500 | 500 – 600 | 100° – 106°F. |
| Carbowax 1540 | 1,300 – 1,600 | 109° – 114°F. |
| Carbowax 4000 | 3,000 – 3,700 | 128° – 134°F. |
| Carbowax 6000 | 6,000 – 7,500 | 140° – 145°F. |

Other nonionic materials can be selected from the group consisting of:

a. the condensation product of 1 mole of a saturated or unsaturated, straight or branched chained aliphatic alcohol having from about 10 to about 24 carbon atoms with from about 10 to about 40 moles of ethylene oxide;
b. the condensation product of 1 mole of a saturated or unsaturated, straight or branched chain aliphatic carboxylic acid having from about 10 to about 18 carbon atoms with from about 20 to about 50 moles of ethylene oxide;
c. aliphatic carboxylic acids containing from about 12 to about 30 carbon atoms;
d. aliphatic alcohols having from about 16 to about 30 carbon atoms;
e. the condensation product of 1 mole of an alkyl phenol, wherein the alkyl chain has from about eight to about 18 carbon atoms, with from about 25 to about 50 moles of ethylene oxide;
f. glycerides, selected from the group consisting of monoglycerides, diglycerides, and mixtures thereof;
g. amides, selected from the group consisting of:
   i. propyl amide,
   ii. N-methyl amides having an acyl chain length of from about 10 to about 15 carbon atoms,
   iii. oleamide,
   iv. amides or ricinoleic acid,
   v. N-isobutyl amides of pelargonic, capric, undecanoic, or lauric acids,
   vi. N-(2-hydroxyethyl) amides having a carbon chain length of from about six to about 10 carbon atoms,
   vii. pentyl anilide,
   viii. anilides having a carbon chain length of from about seven to about 12 carbon atoms, and
   ix. N-cyclopentyllauramide and N-cyclo-pentylstearamide; and,
h. the condensation product of 1 mole of a primary or secondary amine containing at least 12 carbon atoms with from 1 to about 100 moles of ethylene oxide;
i. the products resulting from addition of propylene oxide and ethylene oxide to ethylenediamine such as the Tetronic polyols;
j. block copolymers of ethylene oxide and polyoxypropylene glycol such as the Pluronic polyols;
k. block copolymers of propylene oxide and polyoxyethylene glycol such as the Pluronic R polyols.

The films of this invention are prepared by casting an aqueous solution or dispersion of the aforementioned constituents onto a moving belt. A doctor blade or leveling knife may be used to control the thickness and uniformity of the cast film and the belt may be constructed from stainless steel and coated, if desired, with Teflon or some other suitable release coating in order to improve the releasability of the film. The cast film is then passed through a forced air oven having a temperature of 100°– 320°F. in order to dry the film. The dried film is then stripped from the carrier web, cut and packaged. Alternatively, the films of this invention may be prepared by conventional extrusion techniques or other suitable means. The films of this invention may also be slitted or cut so that each sheet contains a plurality of parallel slits or perforations.

The following examples are illustrative of the preparation of the fabric-softening compositions of this invention.

EXAMPLE 1

80 parts of a 10 percent by weight solution of CMC-7LT, a carboxymethyl cellulose, and 20 parts Varisoft 475, methyl alkylamidoethyl alkyl imidazolinium methylsulfate, are thoroughly mixed and cast on the glass plate. A No. 30 Meyer Rod was used to draw out a film and the solution dried under forced air at 125°F. until a dry film was obtained. The film was then stripped from the glass plate.

Example 2

80 parts by weight of a 10 percent solution of Kelgin XL, sodium alginate and 20 parts by weight of Varisoft 475 were mixed with agitation until a viscous cream was obtained which was cast and dried on a glass plate according to the procedure of Example 1.

EXAMPLE 3

5 parts by weight carboxymethyl cellulose, 5 parts by weight carboxymethyl hydroxymethyl cellulose and 90 parts by weight water were mixed until a viscous gel was obtained. To this gel was added 25 parts by weight Ammonyx 2194, dimethyl ditallow ammonium methylsulfate, and the mixture agitated until a uniform white paste was obtained which was cast and dried according to the procedure of Example 1.

A 3.87 gram sheet of this film was placed in a heated dryer with six wet towels for 50 minutes. The towels had a softness of 2.5 on a scale of 1–4 with 4 being the maximum.

EXAMPLE 4

80 parts by weight of a 10 percent aqueous suspension of Polyox WSRN 80, a polymer of ethylene oxide having a molecular weight of about 200,000, 10 parts by weight Ammonyx 2200-P100, a dimethyl distearyl ammonium chloride cationic surfactant, and 10 parts by weight Avitex NA, a complex alkylamine, were vigorously stirred, cast, and dried according to the procedure of Example 1. In a like manner, 80 parts by weight Polyox 750, a polymer of ethylene oxide having a molecular weight of about 300,000, was mixed with 10 parts by weight Ammonyx 2194, dimethyl ditallow ammonium methylsulfate, and 10 parts by weight Avitex NA to form a film.

A sheet of this film was placed in a heated dryer with six wet towels for 50 minutes. The towels were dry and had a softness of about 2.5. The only residue was several wax-like balls in the lint trap of the dryer.

EXAMPLE 5

78 parts by weight of a 10 percent solution of Polyox WSRN 750, 2 parts by weight Urea, 8 parts by weight Carbowax 6000, a polyethylene glycol having a molecular weight of approximately 6000, 2 parts by weight Drew-9264B, ethoxylated glycerol monostearate, and 10 parts by weight Varisoft 222, a complex difatty alkyl quaternary methosulfate, were thoroughly mixed, cast on a glass plate and dried in accordance with the procedure of Example 1 to produce a film having a composition of 27.1 percent by weight Polyox, 6.9 percent by weight urea, 27.8 percent by weight Carbowax, 6.9 percent by weight Drew 9264B and 31.3 percent by weight Varisoft 222.

EXAMPLE 6

40 parts by weight of a 10 percent solution of aqueous IPA Polyox 750, 17.4 parts by weight of a 10 percent solution of carboxymethyl cellulose, 17.5 parts by weight of a 10 percent solution of carboxymethyl hydroxyethyl cellulose, 0.1 parts by weight of urea, 10.0 parts by weight of a 75 percent concentration of Adogen 442, a dimethyl, dihydrogenated tallow ammonium chloride, 70.0 parts by weight of a 90 percent concentration of Varisoft 222, and 8.0 parts by weight of a 50 percent 6000/50 percent 400 Carbowax mix were thoroughly mixed, cast on a glass plate and dried in accordance with the procedure of Example 1 to produce a film having a composition of 13.85 percent by weight aqueous IPA Polyox 750, 6.07 percent by weight carboxymethyl cellulose, 6.10 percent by weight carboxymethyl hydroxyethyl cellulose, 0.35 percent by weight urea, 26.10 percent by weight Adogen 442, 19.50 percent by weight Varisoft 222 and 27.90 percent by weight Carbowax mix.

EXAMPLE 7

50 parts by weight of a 10 percent solution of Polyox 750, 15 parts by weight of a 10 percent solution of carboxymethyl cellulose, 15 parts by weight of a 10 percent solution of hydroxyethyl cellulose, 5 parts by weight of Adogen 442, 5 parts by weight of Varisoft 222, 9 parts by weight of Carbowax 6000 and 1 part by weight of perfume were thoroughly mixed, cast on a glass plate and dried in accordance with the procedure of Example 1 to produce a dry film having a composition of 19.05 percent by weight Polyox 750, 5.71 percent by weight carboxymethyl cellulose, 5.71 percent by weight hydroxyethyl cellulose, 14.28 percent by weight Adogen 442, 17.14 percent by weight Varisoft 222, 34.29 percent by weight Carbowax 6000, and 3.81 percent by weight perfume.

A sheet of film produced according to this Example was placed in a heated dryer, having six wet towels, for 50 minutes on 11 occasions. The towels were dry, had an average softness of about 2.4, had good fragrance and the film left very little residue in the dryer.

A 10-inch by 10-inch sheet of film produced according to the procedure of this Example was placed, during the rinse cycle, in a home washing machine having six towels and the towels had an average softness of 3.4 after one cycle, 3.3 after five cycles and 3.3 after ten cycles.

EXAMPLE 8

6.6 parts by weight of a 10 percent solution of Polyox WSR205, 6.6 parts by weight polyurethane, 165.0 parts by weight water, 19.9 parts by weight of a 75 percent concentration of Adogen 442, 7.95 parts by weight of a 90 percent concentration of Varisoft 222, 8.85 parts by weight of Carbowax 6000 and 1.1 parts by weight of perfume were thoroughly mixed, cast on a glass plate and dried in accordance with the procedure of Example 1 to produce a dry film having a composition of 14.6 percent by weight Polyox WSR205, 14.6 percent by weight polyurethane, 33.1 percent by weight Adogen 442, 15.8 percent by weight Varisoft 222, 19.6 percent by weight Carbowax 6000, and 2.25 percent by weight perfume.

A sheet of film produced according to this Example was placed in a heated dryer, having six wet towels, for 50 minutes on 11 occasions. The towels were dry, had an average softness of about 2.7 to 2.9, had good fragrance and the film left very little residue in the dryer.

EXAMPLE 9

10.64 parts by weight of a 10 percent solution of Polyox WSR205, 2.66 parts by weight polyurethane, 157 parts by weight water, 19.9 parts by weight of a 75 percent concentration of Adogen 442, 7.95 parts by weight of a 90 percent concentration of Varisoft 222, 8.85 parts by weight of Carbowax 6000 and 1.1 parts by weight of perfume were thoroughly mixed, cast on a glass plate and dried in accordance with the procedure of Example 1 to produce a dry film having a composition of 23.5 percent by weight Polyox WSR205, 5.9 percent by weight polyurethane, 32.9 percent by weight Adogen 442, 15.8 percent by weight Varisoft 222, 19.5 percent by weight Carbowax 6000, and 2.4 percent by weight perfume.

A sheet of film produced according to this Example was placed in a heated dryer, having six wet towels, for 50 minutes on 11 occasions. The towels were dry, had an average softness of about 2 to 2.8, had good fragrance and the film left very little residue in the dryer.

EXAMPLE 10

An emulsion was prepared using 73 percent water, 8.1 percent medium viscosity, fully hydrolyzed polyvinylalcohol, 10.3 percent Adogen 442, 6.2 percent Varisoft 222, 1.4 percent Pluronic F68, 0.25 percent triethanolamine, 0.5 percent sodium acetate, and 0.25 percent perfume oil. The emulsion was then cast onto a glass plate and dried in accordance with the procedure of Example 1 to produce a dry film having the composition of 30 percent polyvinylalcohol, 38 percent Adogen 442, 23 percent Varisoft 222, five percent Pluronic F68, one percent triethanolamine, two percent sodium acetate, and one percent perfume oil.

A sheet of film produced according to this example was placed in a heated dryer, having six wet towels for 50 minutes on 12 occasions. The towels were dry, had an average softness of 2.4, had a good fragrance, and the film left only a crumpled sheet residue behind.

EXAMPLE 11

An emulsion was prepared using 75.9 percent water, 8.4 percent medium viscosity, fully hydrolyzed polyvinylalcohol, 8.4 percent Adogen 442, 5.1 percent Varisoft 222, 1.2 percent Tetronic 707, 0.25 percent triethanolamine, 0.25 percent perfume oil and 0.5 percent sodium acetate. The emulsion was then cast onto a glass plate and dried in accordance with the procedure of Example 1 to produce a dry film having the composition of 35 percent polyvinylalcohol, 35 percent Adogen 442, 21 percent Varisoft 222, five percent Tetronic 707, one percent triethanolamine, two percent sodium acetate and one percent perfume oil.

A sheet of film produced according to this Example was placed in a heated dryer having six wet towels for 50 minutes on 10 occasions. The towels were dry, had an average softness of 2.25, had a good fragrance and the film left only a crumpled sheet residue behind.

We claim:

1. A fabric-softening composition consisting essentially of an essentially uniform, self-supporting preformed film comprising at least one film-forming polymer having a molecular weight of at least 100,000, a fabric softener and a waxy surfactant.

2. A composition as in claim 1 wherein film contains from about 20 to about 50 percent by weight of at least one film-forming polymer, from about 30 to about 75 percent by weight of a fabric softener and from about 1 to about 35 percent by weight waxy surfactant.

3. A composition as in claim 2 wherein the film contains up to about 10 percent by weight of at least one perfume.

4. A composition as in claim 1 wherein the film-forming polymer is a polymer of ethylene oxide.

5. A composition as in claim 1 wherein the film-forming polymer is a polyurethane.

6. A composition as in claim 1 wherein the film-forming polymer is polyvinylalcohol.

7. A composition as in claim 1 wherein the fabric softener is a member selected from the group consisting of cationic quaternary ammonium salts and imidazolium salts, tertiary phosphine oxides, tertiary amine oxides, ethoxylated alcohols and alkyl phenols, ethoxylated amines, anionic soaps, sulfates and sulfonates, amphoteric tertiary ammonium compounds, Zwitterionic quaternary ammonium compounds, and compatible mixtures thereof or one or more compounds of these classes.

8. A composition as in claim 2 wherein the film contains up to about 1 percent by weight of a dye.

9. A process for softening freshly washed fabrics in an automatic rotary drum clothes dryer comprising the steps of:

a. loading said fabrics into the dryer drum and adding a sheet of a fabric softening composition consisting essentially of an essentially uniform, self-supporting preformed film comprising at least one film-forming polymer having a molecular weight of at least 100,000, a fabric softener and a waxy surfactant; and b. operating said dryer, whereby the action of the clothes dryer provides contact of the fabrics with the fabric softening composition to effect softening of the fabrics.

10. A process as in claim 9 wherein the film contains from about 20 to about 50 percent by weight of at least one film-forming polymer, from about 30 to 75 percent by weight of a fabric softener and from about 1 to about 35 percent by weight waxy surfactant.

11. A process as in claim 10 wherein the film contains up to about 10 percent by weight of at least one perfume.

12. A process as in claim 10 wherein the film contains up to about 1 percent by weight of a dye.

13. A process as in claim 9 wherein the film-forming polymer is a polymer of ethylene oxide.

14. A process as in claim 9 wherein the film-forming polymer is a polyurethane.

15. A process as in claim 9 wherein the film-forming polymer is polyvinylalcohol.

16. A process as in claim 9 wherein the fabric softener is a member selected from the group consisting of cationic quaternary ammonium salts and imidazolium salts, tertiary phosphine oxides, tertiary amine oxides, ethoxylated alcohols and alkyl phenols, ethoxylated amines, anionic soaps, sulfates and sulfonates, amphoteric tertiary ammonium compounds, Zwitterionic quaternary ammonium compounds, and compatible mixtures thereof of one or more compounds of these classes.

* * * * *

UNITED STATES PATENT AND TRADEMARK OFFICE

CERTIFICATE OF CORRECTION

PATENT NO. : 3,936,538

DATED : February 3, 1976

INVENTOR(S) : Susan Kathryn Marshall, Thomas Graham Gerding, Elmer Miller King

It is certified that error appears in the above-identified patent and that said Letters Patent are hereby corrected as shown below:

Column 12, claim 7, line 15 "or one" should read -- of one --.

Signed and Sealed this

Thirteenth Day of July 1976

[SEAL]

*Attest:*

RUTH C. MASON
*Attesting Officer*

C. MARSHALL DANN
*Commissioner of Patents and Trademarks*